US009387384B2

(12) United States Patent
Mehr

(10) Patent No.: US 9,387,384 B2
(45) Date of Patent: Jul. 12, 2016

(54) FALL PROTECTION DEVICE

(75) Inventor: Christian Mehr, Oberentfelden (CH)

(73) Assignee: Angehrn AG Umformtechnik, Degersheim (CH)

( * ) Notice: Subject to any disclaimer, the term of this patent is extended or adjusted under 35 U.S.C. 154(b) by 521 days.

(21) Appl. No.: 13/256,356

(22) PCT Filed: Mar. 17, 2010

(86) PCT No.: PCT/EP2010/001654

§ 371 (c)(1),
(2), (4) Date: Oct. 18, 2011

(87) PCT Pub. No.: WO2010/105804

PCT Pub. Date: Sep. 23, 2010

(65) Prior Publication Data

US 2012/0018249 A1 Jan. 26, 2012

(30) Foreign Application Priority Data

Mar. 17, 2009 (DE) ..... 10 2009 013 203

(51) Int. Cl.

| | |
|---|---|
| ***A63B 69/00*** | (2006.01) |
| *A61H 3/00* | (2006.01) |
| *A63B 5/11* | (2006.01) |

(52) U.S. Cl.

CPC ..... *A63B 69/0064* (2013.01); *A61H 3/008* (2013.01); *A61H 2201/0173* (2013.01); *A61H 2201/165* (2013.01); *A61H 2201/1616* (2013.01); *A61H 2201/1621* (2013.01); *A63B 5/11* (2013.01)

(58) Field of Classification Search

CPC ..... A63B 5/11; A63B 69/0064; A61H 3/008
USPC ..... 182/231–233, 235; 472/135; 482/69
See application file for complete search history.

(56) References Cited

U.S. PATENT DOCUMENTS

| | | | | |
|---|---|---|---|---|
| 2,107,377 | A * | 2/1938 | Howland | 482/43 |
| 3,780,663 | A * | 12/1973 | Pettit | 104/307 |
| 4,344,617 | A | 8/1982 | Murphy | |
| 4,410,175 | A | 10/1983 | Shamp | |
| 4,449,716 | A | 5/1984 | Goldy | |
| 4,634,118 | A * | 1/1987 | Jensen | 482/94 |

(Continued)

FOREIGN PATENT DOCUMENTS

| | | |
|---|---|---|
| DE | 198 05 164 C1 | 5/1999 |
| DE | 10 2006 028 363 B3 | 8/2007 |

(Continued)

OTHER PUBLICATIONS

International Preliminary Report on Patentability of International Application No. PCT/EP2010/001654 dated Sep. 20, 2011.

(Continued)

*Primary Examiner* — Alvin Chin-Shue
*Assistant Examiner* — Kristine Florio
(74) *Attorney, Agent, or Firm* — Fay Sharpe LLP

(57) ABSTRACT

A fall protection device for trampolines includes at least one rope which is preferably substantially non-resilient and can be connected to a user of the trampoline. At least one tautening device is provided for holding the rope taut when the fall protection device is in use. Also provided is at least one device for limiting the rope extension.

24 Claims, 7 Drawing Sheets

(56) References Cited

U.S. PATENT DOCUMENTS

| | | | | | |
|---|---|---|---|---|---|
| 4,778,174 | A | * | 10/1988 | Tolsma | 482/15 |
| 4,997,064 | A | * | 3/1991 | Motte et al. | 182/231 |
| 5,064,191 | A | * | 11/1991 | Johnson | 482/143 |
| 5,094,448 | A | * | 3/1992 | Hackett | 472/135 |
| 5,184,992 | A | * | 2/1993 | Banks | 482/104 |
| 5,190,507 | A | | 3/1993 | Iijima | |
| 5,221,241 | A | * | 6/1993 | Bare, II | 482/43 |
| 5,421,783 | A | * | 6/1995 | Kockelman et al. | 472/135 |
| 5,577,984 | A | * | 11/1996 | Bare, II | 482/43 |
| 5,603,677 | A | * | 2/1997 | Sollo | 482/69 |
| 5,626,540 | A | * | 5/1997 | Hall | 482/69 |
| 5,667,461 | A | * | 9/1997 | Hall | 482/69 |
| 5,695,432 | A | * | 12/1997 | Soderlund | 482/69 |
| 5,704,881 | A | | 1/1998 | Dudley | |
| 5,788,606 | A | * | 8/1998 | Rich | 482/27 |
| 6,273,844 | B1 | * | 8/2001 | Kelsey et al. | 482/54 |
| 6,302,828 | B1 | * | 10/2001 | Martin et al. | 482/69 |
| 6,443,877 | B1 | * | 9/2002 | Hoecht et al. | 482/103 |
| 6,488,612 | B2 | * | 12/2002 | Sechrest et al. | 482/103 |
| 7,179,209 | B2 | * | 2/2007 | Sechrest et al. | 482/103 |
| 7,182,695 | B1 | * | 2/2007 | Tostenson et al. | 472/50 |
| 7,468,023 | B2 | * | 12/2008 | Wu et al. | 482/69 |
| 7,608,024 | B2 | * | 10/2009 | Sechrest et al. | 482/103 |
| 8,070,658 | B2 | * | 12/2011 | Giannelli et al. | 482/102 |
| 8,096,922 | B2 | * | 1/2012 | Planke | 482/7 |
| 8,192,331 | B2 | * | 6/2012 | Colombo et al. | 482/69 |
| 8,708,872 | B2 | * | 4/2014 | Giannelli et al. | 482/102 |
| 2007/0173384 | A1 | * | 7/2007 | Sechrest et al. | 482/99 |

FOREIGN PATENT DOCUMENTS

| | | | |
|---|---|---|---|
| GB | 2 374 552 | A | 10/2002 |
| WO | WO 03/35184 | A1 | 5/2003 |

OTHER PUBLICATIONS

International Search Report of International Application No. PCT/EP2010/001654 dated Jul. 6, 2010.

* cited by examiner

FALL PROTECTION DEVICE

The invention relates to a fall protection device for trampolines.

Trampolines are firmly established in modern physiotherapy. When exercising on a trampoline most of the muscles in the human body are used. With one single simple exercise apparatus a large number of muscle groups can be activated and trained. Training on a trampoline also has a positive influence on the metabolism and trains the sense of balance.

A so-called mini-trampoline is known from DE 10 2006 028 363 B2, in which the jumping mat is suspended on individual resilient strap sections. The trampoline has proved excellent for use in the leisure sector and also in the physiotherapy sector and in the preventive promotion of good health.

Trampolines have already been used in the past for people with disabilities. However, the training could not be carried out by the person alone, but almost exclusively when accompanied by an experienced physiotherapist. Associated with this are considerable risks both for the user and for the person accompanying them. Regardless of this, the associated staffing costs are considerable. The invention is directed in particular to groups of people with disabilities as well as older people at risk of falling. However, the possible applications of the invention are not limited to this group of people.

People with progressive disabilities such as multiple sclerosis, dementia or Parkinson's disease and also older people quickly lose their musculature and their balance owing to lack of movement. With diminishing activity this group of people is increasingly exposed to risks. Also people with different congenital disabilities (such as for example cerebral palsy) or people who have to live with restricted mobility following an injury often put on weight as a consequence of their lack of movement and as a result they also lose mobility. The same applies to ageing people.

The loss of muscle strength and balance has fatal effects on the personal mobility and the quality of life of those affected. Apart from the direct effects for the affected people, the lack of movement also has effects on society. In particular the care requirements increase considerably and so also do the healthcare costs borne by the public.

The object of the invention is to make the positive effect of training on a trampoline also accessible without danger for users with disabilities and those with impaired balance.

In order to achieve this object, the fall protection device referred to in the introduction is characterised according to the invention by

- at least one rope which can be connected to a user of the trampoline,
- at least one tautening device which holds the rope taut when the trampoline is in use, and
- at least one device for limiting the rope extension.

The fall protection device according to the invention opens up completely new possibilities for therapy. For the first time it is also possible for people with a severe disability, or also older people at risk of falling, to train alone independently on a trampoline without being exposed to a risk of falling with serious consequences. In people with mobility restrictions this training promotes/activates essential bodily functions (urinary incontinence/digestion) and supports an energy consumption which is unusual for the life situation.

The rope is preferably substantially non-resilient. It may for example be a wire rope or a natural or synthetic fibre rope.

The substantially non-resilient rope is connected to the user before use of the trampoline. For this purpose the user preferably wears a safety vest into which the rope is clipped. When bouncing on the trampoline the rope is pulled out and pulled back in and held taut by the tautening device. The aim in this case is that the tautening device exerts the lowest possible retraction force on the user in order to train the natural sense of balance and the reactive capabilities associated therewith.

Securing systems are known from WO 03/035184 A1 and DE 198 05 164 C1. The known securing systems are used on treadmills and locomotion systems. The objective, apart from securing the user, is to lift the user (patient) so that part of his body weight is supported during walking/running. In terms of construction the known securing systems are designed exclusively so that the user moves in or above the walking/running plane.

The known systems are unsuitable for use with a trampoline. The user is to some extent lifted, to some extent controlled by force by the known systems. With the invention, on the other hand, the patients should bear their own body weight when trampoline training. The retraction force of the tautening device should be as low as possible, so that the patient can train balance reflexes and fine motor functions under realistic conditions.

Furthermore when using the trampoline according to the invention the patient is exposed to conditions which are not comparable to (weight-supported) walking training. During the upward bounce the body experiences a relative weightlessness, and during the downward bounce the body experiences an increasing weight force. In this case in the downward bounce on the trampoline the patients drop significantly below the zero plane (that is to say the plane in which the trampoline is loaded with the body weight in the rest position). Unrestricted sensing/experiencing of these conditions is essential for the therapeutic effect. The known systems are also not designed for this.

According to the invention the fall protection device allows training on the trampoline. Thus the tautening device is constructed so that during use of the trampoline over the entire bouncing amplitude on the one hand sufficient rope is available and on the other hand the rope is held taut. At the same time the tensile force of the rope is set so that the patient does not perceive the rope subjectively or only perceives it to a quite limited extent. Thus the main function of the rope is to secure the patient in the event of a fall.

If a fall occurs, the rope extension is limited by the device for limiting the rope extension. This prevents the user from falling from the trampoline or being exposed to risk of injury. This applies above all when the rope extension is limited so that the user of the trampoline does not "fall down" but is already caught immediately after inadvertent departure from the usual bouncing curve. In such a position where he is caught early it will generally be possible for the user to resume the training position by himself. Targeted regulation of the depth of fall enables patients with growing reflex competence to learn to right themselves from lower falling positions.

Suspension means with resilient ropes for trampoline users are known from the prior art. Such (highly) resilient ropes are completely unsuitable for the invention. In fact it is of central importance in the invention that in the event of a fall the user is not catapulted out of the (inadvertent) falling position but is held in the falling position so that then the possibility exists of getting back into the training position.

According to the invention the rope should be substantially non-resilient. This characteristic takes account of the fact that any rope always has a certain resilient component. However, according to the invention no pure rubber rope or woven resilient rope having the aforementioned disadvantage should be used.

The tautening device may for example be a weight. The size of the weight should be chosen so that on the one hand it holds the rope substantially taut, but on the other hand it has the least possible influence on the user's perception. In the therapy the user should—in addition to muscle building—also sharpen the sense of balance and all necessary reaction and compensation reflexes.

As an alternative to the weight, a spring-loaded winding device may be used.

An advantageous embodiment of the invention is characterised in that the device for limiting the rope extension has a stop. The stop defines the end position of the patient in the event of a fall.

It may be provided that the tautening device co-operates with the stop. In this case the tautening device itself is constructed as a stop on the rope side.

Basically it has proved worthwhile for the tautening device to be guided. This has the advantage that any additional forces due to unwanted swinging of the tautening device are avoided.

In the fall protection device according to the invention a rope is used which is substantially non-resilient. Nevertheless cushioning of a fall is desirable. In a further development of the invention, therefore, it is proposed that the device for limiting the rope extension has at least one damper. This may in particular be a gas spring, a spring or in certain cases a rubber or plastic stop. Pneumatic or hydraulic for example which cushion a possible fall are basically advantageous.

The degree of damping of the damper is preferably adjustable. Thus the fall protection device according to the invention can be adapted individually to users with differing body weights and/or training progress.

The damper is advantageously connected to one end of the rope. The other end is advantageously connected to a deflection roller around which the rope is wound. In the event of a fall the end of the rope and the deflection roller move towards one another until the rope extension is limited.

The damper may itself act as a stop. Alternatively a separate stop will be provided to limit the rope extension, so that the damper exclusively takes over the damping function.

In a significant further development of the invention it is proposed that the length of the free end of the rope is adjustable. Thus the fall protection device according to the invention can be adjusted to the body size of the user.

It has proved advantageous to set the rope length by adjustment of the device for limiting the rope extension. For example it may be provided that the fall protection device has a stationary toothed rack and that the rope length is adjusted by way of a movable carriage which can be brought into engagement with the toothed rack. On the one hand the toothed rack allows for fine engagement, that is to say precise adaptation to the user. On the other hand the toothed rack provides strong and secure latching.

For fall prophylaxis training the patient must progressively become used to different fall heights. In order to achieve this an advantageous embodiment of the invention is characterised in that the fall height of the user is adjustable. As a result the end position of the patient in the event of a fall is defined. Adjustment of the fall height is generally achieved by adjustment of the device for limiting the rope extension. In particular may be provided that the adjustment takes place by way of the damper.

For adjustment of the fall height care should be taken to ensure that in the initial stage of training the rope extension is preferably set to only a few centimeters deviation from the bouncing amplitude, so that if the user loses his balance he can be caught before an actual fall occurs. The use should not fall so low since otherwise he cannot right himself under certain circumstances. Moreover in the event of falling too low there is a considerable risk of injury. The objective is to provide experience of falling and to train the user's fall prevention reflexes.

As already stated above, the tautening device can be constructed in a simple design for example as a weight. A tautening device which has a device for deflecting the rope is regarded as particularly advantageous. The device for deflecting the rope may have a roller which effects a deflection of the rope. The tautening device preferably has a pivotable lever by means of which the rope is deflected in use. The section of rope connected to the user is shortened by the deflection of the rope. Such a design enables secure tautening of the rope even in the case of rapid changes of load.

A significant advantage of the lever is the comparatively low-noise operation. As a result the patient does not experience any irritating background noise when practising, which enables him to feel safe and to give his full concentration to his sequences of movement. Moreover the design of the lever may be such that it only has a low weight. This also has an advantageous effect on perception of the patient.

The tautening device will preferably be disconnected from the device for limiting the rope extensions. Therefore their functions are separated from one another. Also it may be provided that the tautening device and the device for limiting the rope extension are locally separated from one another.

The basic setting of the lever should be chosen so that in the weighted rest position in which the user stands on the trampoline hut is not yet moving the lever already deflects the rope. With subsequent bouncing up and down the rope is increasingly deflected more (upward bounce and less (downward bounce).

Beyond a certain point no further deflection advantageously takes place. Then the rope is just tensioned. In this position the device for limiting the rope extension can be activated, as is set out in greater detail below.

It has proved advantageous that the lever bears against the rope with a pretension. Basically it is conceivable that the lever only deflects the rope with its own weight. However, it is particularly advantageous if the pretension of the lever is adjustable. This may be achieved for example by way of a spring, in particular a coil spring which is disposed in the region of the suspension of the lever.

A preferred embodiment of the lever is characterised in that the lever is mounted on one side and that a guide roller for the rope is disposed on the bearing axis of the lever. Thus with one end the lever deflects the rope (for this purpose the lever also has a roller) and with its other end the lever is fixed on the fall protection device, wherein the rope is guided over the guide roller. Such a construction is smooth-running, reliable, compact and durable.

Basically it is advantageous if the rope limiting device is only activated when the rope extension has reached a defined length. This length is reached when the patient leaves the normal bounce path (optionally with an additional safety factor). A particularly advantageous embodiment of the invention is characterised in that the device for limiting the rope extension is only activated when the deflection is terminated. Thus in normal training operation the tautening device acts. In the event of a fall the deflection is terminated and the entire rope is tautened so that it activates the device for limiting the rope extension. In practice the limitation of the rope extension is initiated with damping so that the user does not too hard.

In a very simple embodiment the fall protection device according to the invention can be suspended on the ceiling.

However, in some circumstances this involves the risk that the ceiling does not hold the fall protection device. In this respect it is regarded as particularly advantageous if the device has an arm. The arm extends over the user.

The arm will be fixed directly on a side wall or preferably on a vertical support which in turn is fixed on the wall. Thus with the vertical support and the arm a system can be made available by the manufacture which has a static and dynamic stability per se. The system merely needs to be fixed on a wall, the vertical forces being deflected via the vertical support.

A free-standing construction is also conceivable.

The arm preferably projects with its front end over the trampoline. Thus the arm is dimensioned so that a conventional mini-trampoline is located below the arm. Access to the trampoline will optionally be provided below the arm, as is explained in greater detail below.

The tautening device and/or the limitation of the rope extension are advantageously disposed in the rear region of the arm. In particular the aforementioned elements can be disposed in the vertical support construction, that is to say for example between two vertical supports. There they are well protected and easy to operate.

A guiding device, in particular a guide roller which guides the rope to the rear end of the arm will be disposed on the front end of the arm. The rope is preferably guided there by a guide roller system which is advantageously designed so that the rope length can be set by movement of at least one of the guide rollers.

The fall protection device may be used in various versions. The versions can be adapted to differing levels of performance of users or the degree of disability of patients. In the case of patients with a greater disability it is advantageous if an aid is provided by which the patient gets to the trampoline and onto the trampoline. An advantageous design is characterised in that the device has a transport device which is disposed so that it can be moved along the arm. Thus from the starting position the user will grip the transport device and can advantageously be supported thereon and thus can reach the trampoline. The transport device may be configured in such a way that an upper carriage slides on a rail associated with the rm.

In addition a safety device can be provided for securing the patient. The safety device may be a rope or a belt system or the like which the user clips into the safety vest he is already wearing. As soon as the user has arrived on the trampoline he will clip in the training rope and will release the safety device.

The invention is primarily directed to users with disabilities or difficulties with walking. With the aid of the trampoline a large number of muscles in the body are strengthened and trained. At the same time the sense of balance and the fall prevention reflexes are trained. For this it is important that the user/patient does not experience a strongly active support in the sense of an upwardly acting tensile force. A tensile force which is too strong would falsify the sensation of balance.

In this connection it is proposed that not only a (traction) rope but also two independent ropes are provided which secure the user on both sides. In practice, as already mentioned, the user will wear a vest into which the ropes are clipped one on each side in the region of the shoulders.

For adaptation to the user (in size and/or width) the rope is preferably guided over a flexible guide roller, in particular a pivotable guide roller. If an arm is used, the flexible guide roller will be provided in the end region of the arm. In a concrete embodiment the guide roller can be mounted for example in a mounting which is pivotably retained on the arm. An alternative embodiment is characterised in that the guide roller is fixed on a wire rope which is advantageously fixed on the arm. The flexible wire rope enables a flexible orientation of the rope.

Each of the two ropes is advantageously connected to one tautening device.

The invention is explained in greater detail below with reference to a preferred embodiment in connection with the appended drawings, in which.

Figure 1:
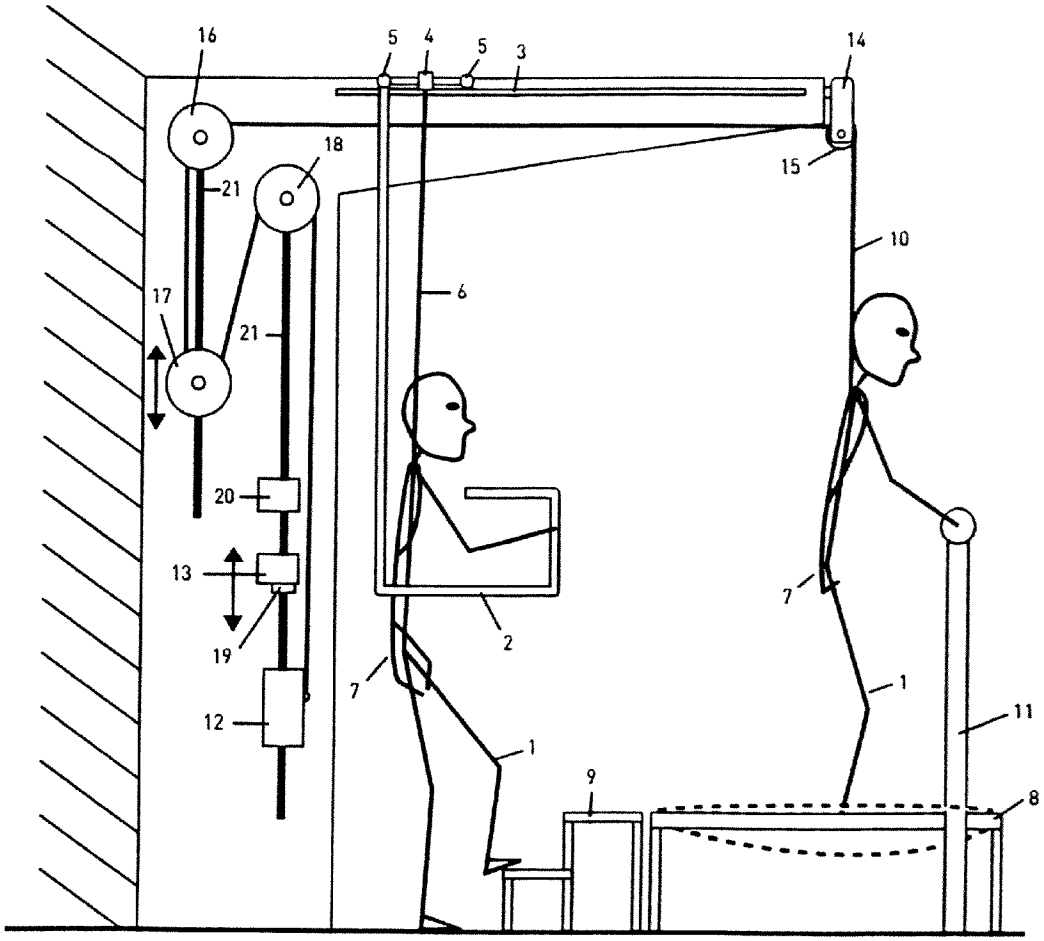
FIG. 1 shows the principle by which a fall protection device according to the invention functions.

FIG. 1 shows the principle by which a fall protection device according to the invention functions with reference to a first embodiment. Two states are shown schematically in FIG. 1. On the left-hand side in FIG. 1 the person 1 with walking difficulties is gripping a transport device 2 on which the person can support himself. The transport device 2 is movably mounted on a rail 3. For this purpose the transport device 2 has a carriage 4 which slides with two rollers 5 on the rail 3.

In addition to supporting the person by the transport device 2, the person is secured on a safety device 6 which in the present case is constructed as a rope, wire or belt system and is connected to the carriage 4.

The person 1 wears a safety vest 7 into which the safety device 6 is clipped in the region of the shoulders.

In order to get onto the trampoline 8 the person 1 must first of all walk in the direction of the trampoline and for example climb steps 9. In doing so the person 1 can support himself on the transport device 2 which travels along the rail 3 to the training position which is identified by the person on the right in FIG. 1.

If the person has arrived on the trampoline 8 the person will initially secure himself with a second rope 10—the training rope—before he releases the first rope 6. The second rope 10 as well as the safety device 6 is clipped into the vest in the region of the shoulders of the person 1. For additional stabilisation the person can hold onto a holding bar 11.

On the trampoline 8 the person 1 carries out his bouncing practice. In this case the rope 10 tracks the amplitudes of the bounces of the trampoline mat. For this purpose a weight 12 which always holds the rope substantially taut is fastened to the end of the rope 10. In the event of the person 1 falling the weight 12 strikes a stop 13. This limits the rope extension and the person is caught in spite of the fall.

The rope 10 is guided in several ways. A first guide roller 15 over which the rope 10 is guided onto the rear face of the arm is disposed. In the front region of the arm. Then the rope 10 is guided over further rollers 16, 17 and 18.

The fall protection device can be adjusted in several ways. A first adjustment of the usable length of rope is effected by way of the roller 17 which is disposed so as to be movable in the direction of the double arrow. As the roller 17 is moved into an upper position the usable rope length becomes longer and vice versa. In this way it is possible for example to adapt the usable rope length to the body size of the user 1.

A second adjustment is carried out by the stop 13. This stop is also adjustable in the direction of the double arrow. The catching height after a fall can be set for example by adjustment of the stop. In order that the person is not slowed down too abruptly in the event of a fall the stop 13 is provided with a damping device 19. This may for example be a rubber or plastic buffer, a compressed gas cylinder or a pneumatic or hydraulic damper.

In the illustrated embodiment the damping device 19 is assigned with the stop 13. It is within the scope of the invention to assigned the damping device 19 to the weight.

The reference numeral 20 denotes a second stop which has an additional securing function and acts as an end stop.

The adjustable roller 17 and/or the adjustable rope extension limiting device 13 are guided on rails or bars 21. This enables simple adjustment and fixing in a desired position.

Figure 2:
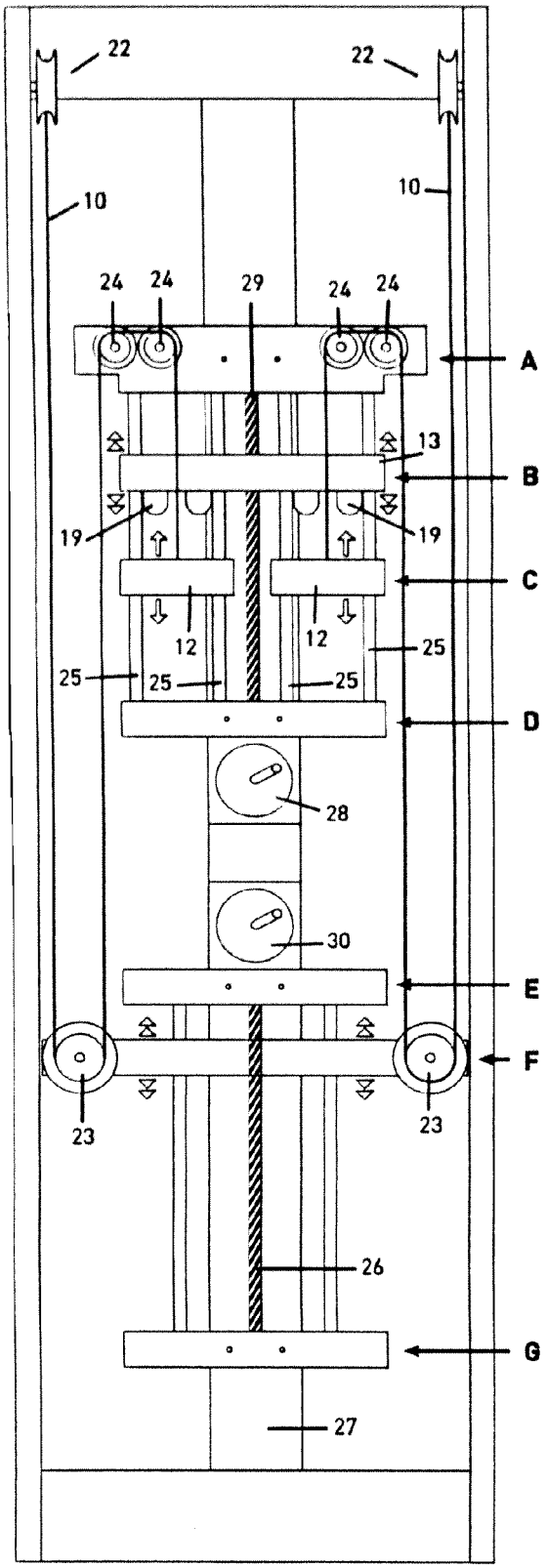
FIG. 2 shows a schematic representation of a second embodiment of a fall protection device according to the invention.

FIG. 2 shows the rear end of a second embodiment of the fall protection device according to the invention in a front view. By comparison with FIG. 1 it is clear that two ropes 10 can be used here, each rope 10 being attached or hooked in on one side of the user's vest (not shown here).

Each rope 10 is guided in several ways, namely over a stationary roller 22, an adjustable roller 23 and stationary rollers 24. The weight 12 is fixed on the end of the rope 10 and holds the rope tensioned. In the end position the weights 12 strike the stop 13 and are damped by the buffers 19. The weights 12 are guided on bars 25.

The illustrated embodiment has the following modules:

A crosspieces on which the rollers 24 are mounted;

B crosspiece which together with the dampers 19 form the stop 13;

C weights 12 which are connected to the rope 10;

D upper drive unit for adjusting the stop 13 in the direction of the arrow;

E lower drive unit for adjusting the lower rollers 13;

F crosspiece on which the rollers 23 are mounted;

G mounting for the threaded rod 26.

The stationary modules A, D, E and G are fixed on a vertical strut 27. The module B is adjusted via the drive unit D. The latter has a manual crank 28 which can actuate a threaded rod 29 which is in threaded engagement with the module B. The module F is adjusted by way of the drive unit E. The latter has a manual crank 30 which drives the threaded rod 26 which is in threaded engagement with the module F. It goes without saying that instead of the manual crank motor-drive drive units can also be used.

Figure 3:
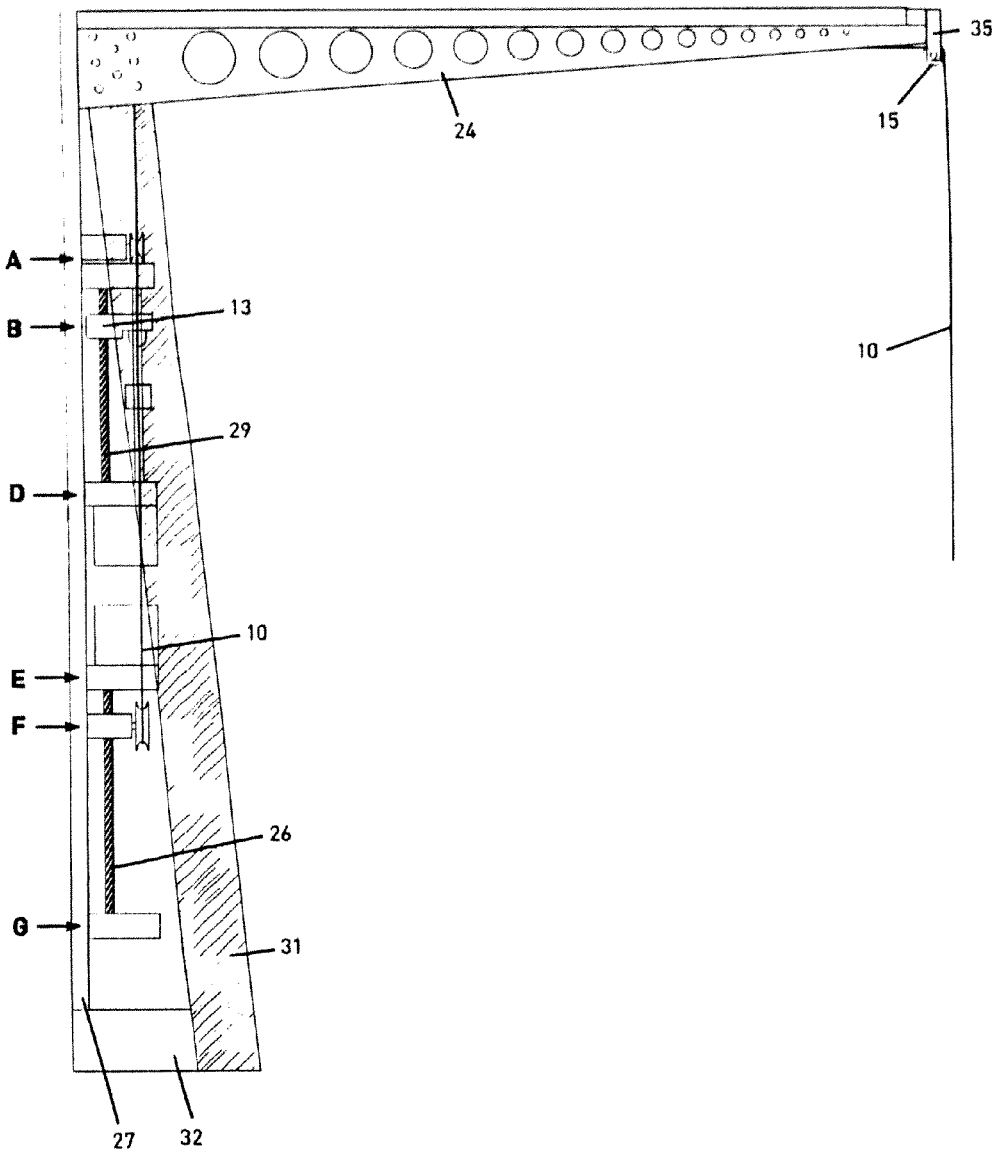
FIG. 3 shows the fall protection device according to FIG. 2 in a side view.

FIG. 3 shows the second embodiment in a side view. The arm 14 is connected to a vertical support 31 which deflects most of the forces of the arm. For reasons of clarity the vertical support 31 is shown semi-transparent. The fall protection device bears against the wall by way of the horizontal supports 32. Overall the arm 14, the vertical support 31 and the horizontal support 32 substantially form a Z shape in side view. In this case the vertical support 31 projects forwards in such a way that the aforementioned modules are located behind the plane formed by the vertical support(s) 31 and in this respect are protected.

Figure 4:
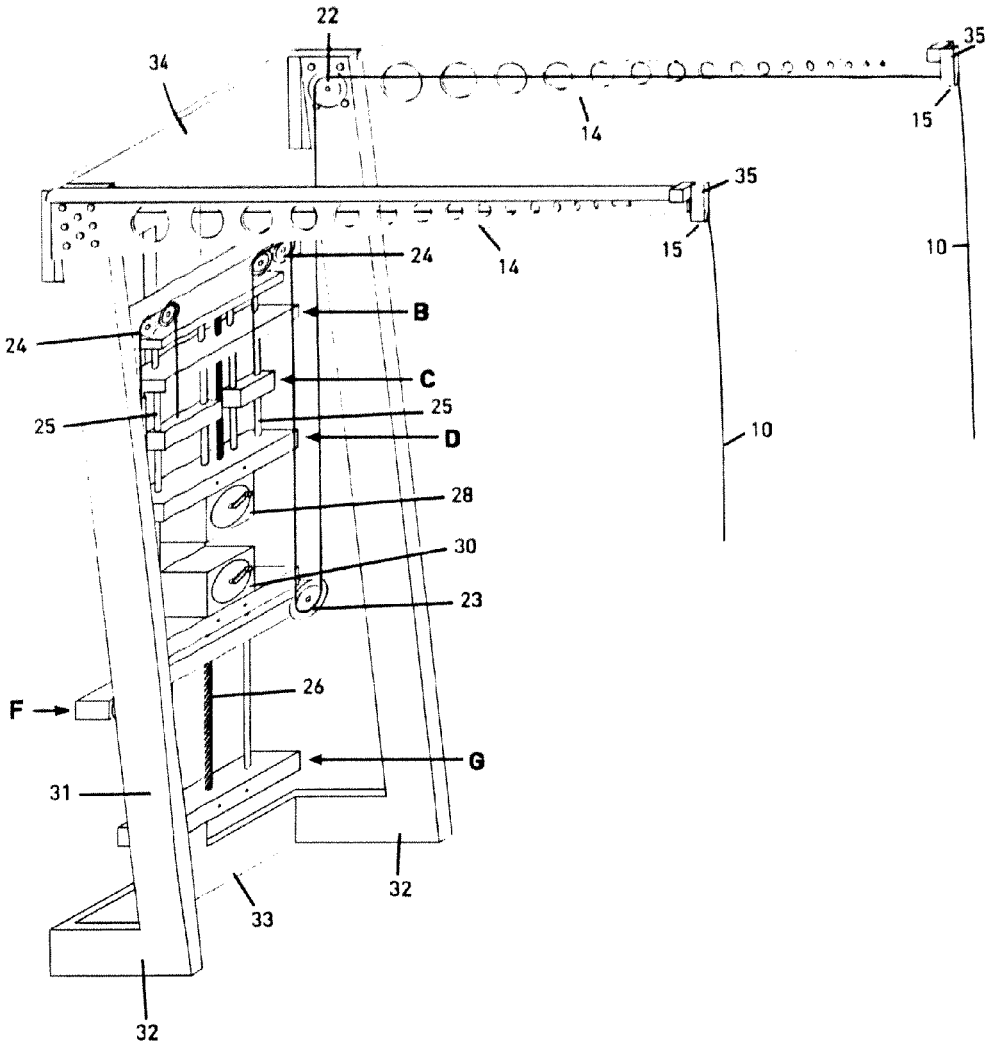
FIG. 4 shows the fall protection device according to FIG. 2 and FIG. 3 in a perspective view.

FIG. 4 shows the second embodiment in a perspective view. The fall protection device is fastened to a wall (not shown) by an upper transverse bar 34 and optionally a lower transverse bar 33. The run of the rope has already been substantially explained in connection with FIG. 2.

It can be seen from FIG. 4 how the rope is guided over the rear guide rollers 22 to the front section of the arm 14 and over the front guide rollers 15 in the direction of the user (not shown). The guide rollers 15 are received in a mounting 35 which makes it possible for the guide rollers to pivot inwards. As a result the guiding of the rope can be adapted particularly advantageously to users with different shoulder widths or users of different sizes. The adaptation takes place automatically by the rope traction mechanism.

Since in the illustrated embodiment two ropes 10 are used, the fall protection device according to the invention enables a symmetrical design of the overall constructions. Moreover the modules A, B, D, F and G are designed so that they support the respective assemblies for the left-hand rope and the right-hand rope. Only the module C which comprises the weights 12 is individually constructed, since the particular rope 10 must be capable of individual actuation.

Figure 5:
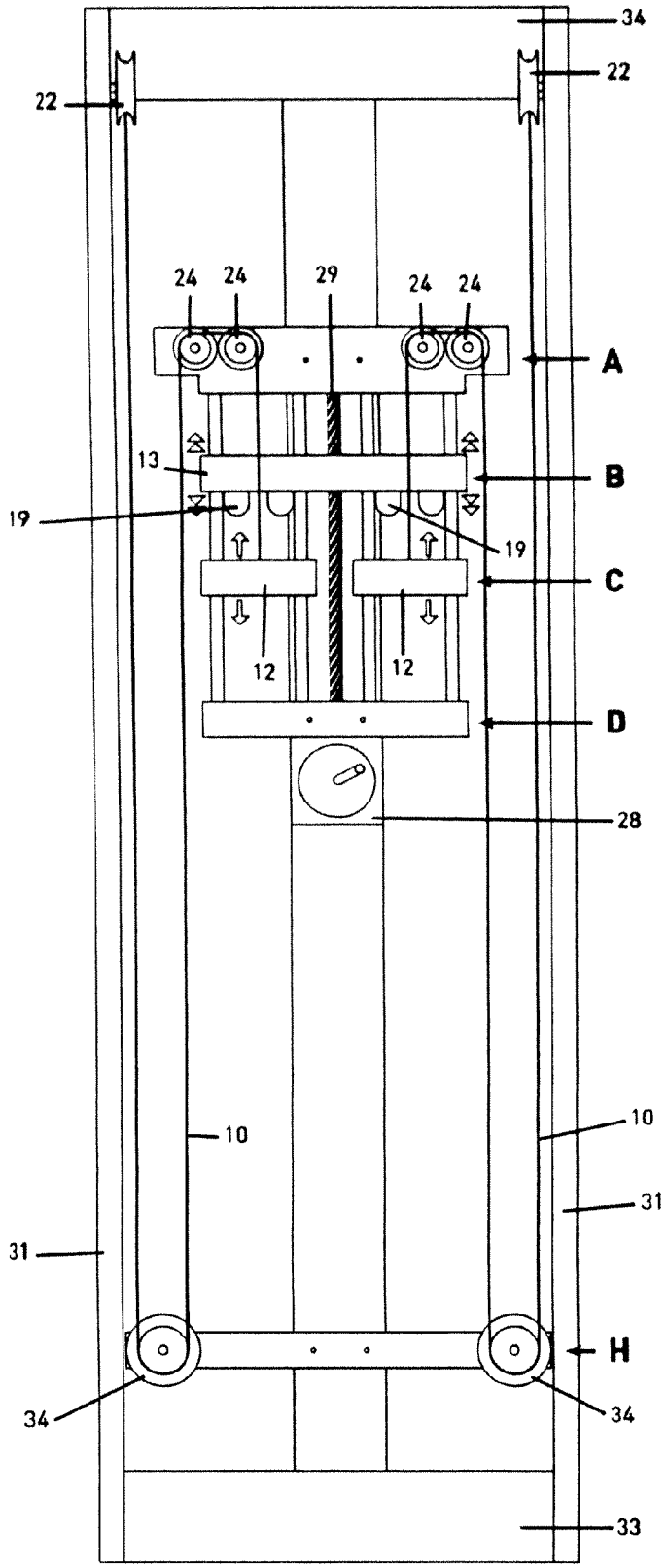
FIG. 5 shows a schematic representation of a third embodiment according to the invention.

FIG. 5 shows a version of the fall protection device which is simplified relative to the second embodiment. In this case the adjustable module F and the associated modules E and G are omitted. The setting of the usable rope length and the setting of the fall height takes place exclusively by way of the drive unit D which adjusts the stop module B. Only one module H which supports two guide rollers 34 is disposed instead of the modules E, F and G in the lower region of the fall protection device.

Figure 6:
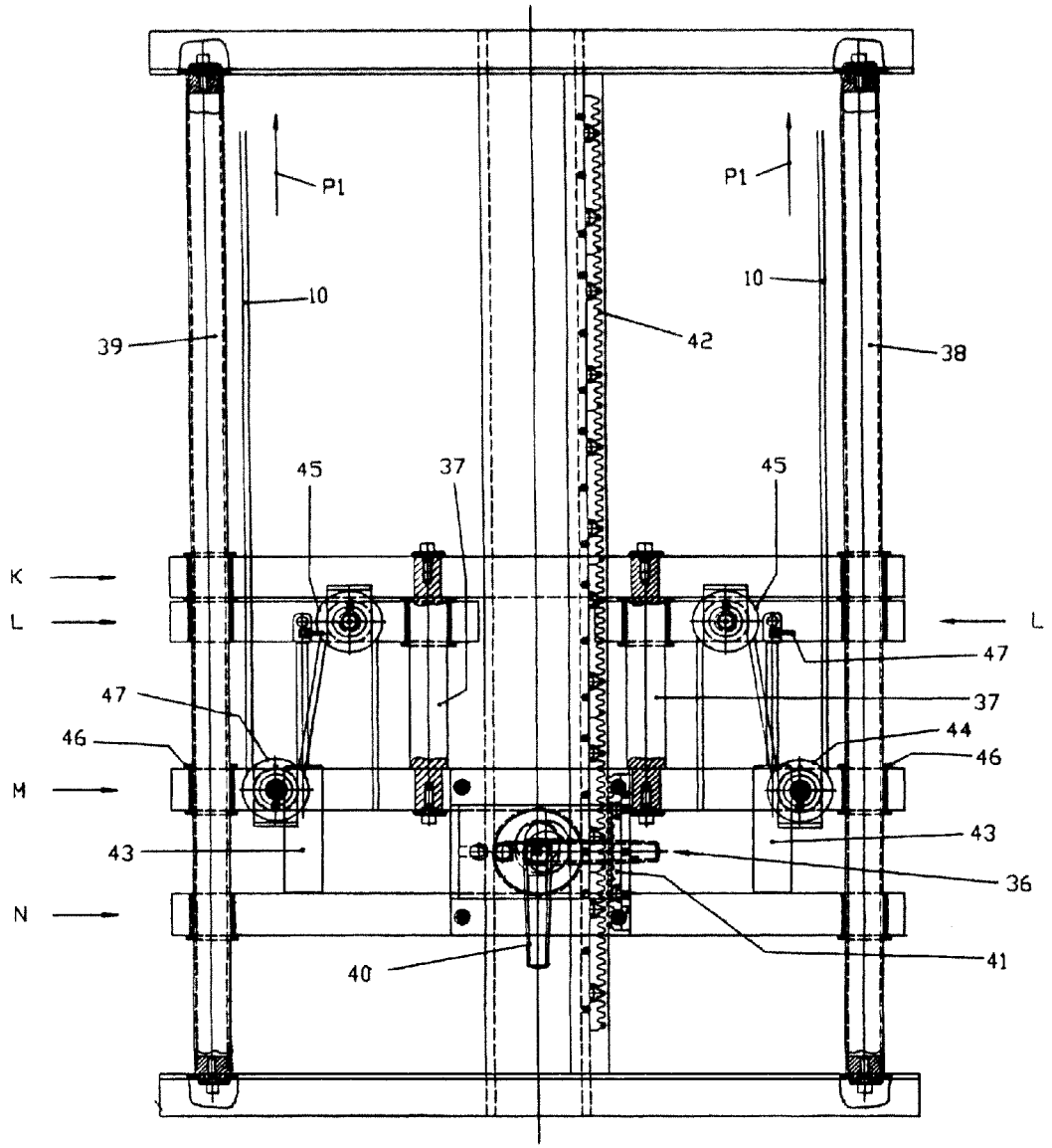
FIG. 6 shows a detail of a fourth embodiment according to the invention.
Figure 7A:
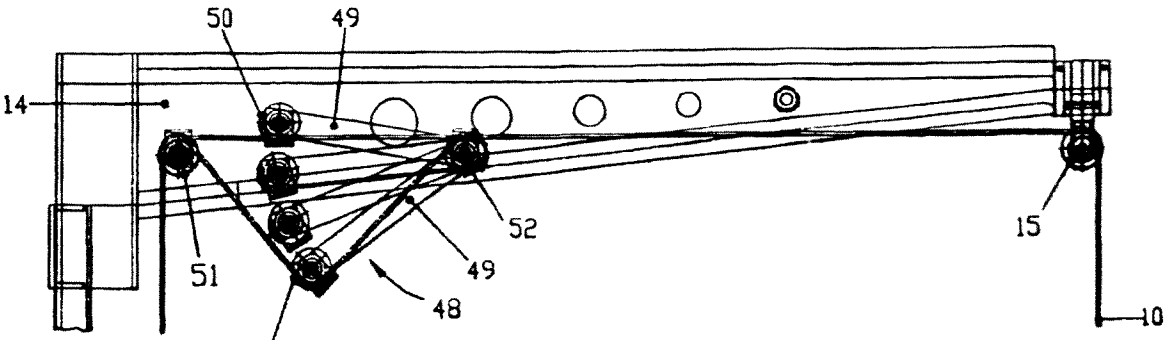
FIG. 7A shows a side view of an upper portion of the embodiment of FIG. 6.
Figure 7B:
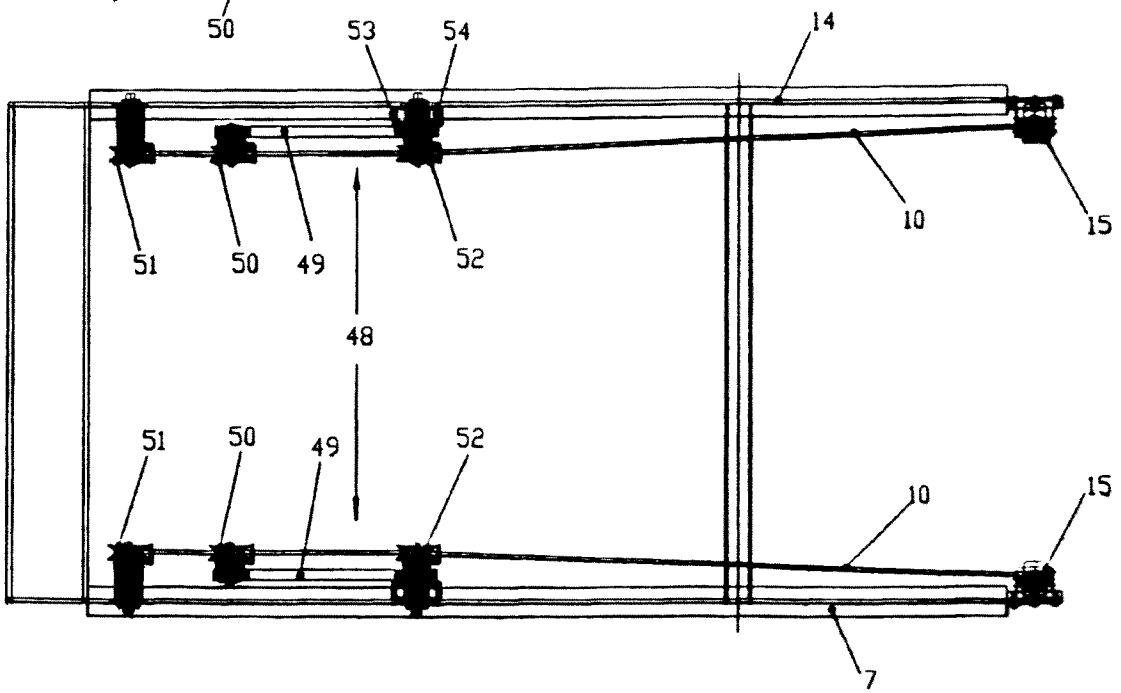
FIG. 7B shows a top view of the embodiment of FIG. 6.

A fourth embodiment of the fall protection device according to the invention is shown in FIGS. 6 and 7, wherein a device for limiting the rope extension is shown in FIG. 6 and a tautening device is shown in FIG. 7.

Reference is made to FIG. 6. The illustrated embodiment has five crosspieces. The crosspieces K. M and N are connected to one another, the crosspieces N and M being connected by way of a locking device 36 and the crosspieces M and K being connected by way of guide bars 37. The two crosspieces L lie in a horizontal plane and are movable separately from one another. All crosspieces K, L, M, N are mounted by way of outer bars 38 and 39, the two crosspieces L additionally by way of the guide bars 37.

The length of the rope 10 is set by way of the locking device 36. For this purpose the locking device 36 has a handle 40 by which by means of an eccentric a carriage 41 connecting the crosspieces M and N can be brought into engagement with a stationary toothed rack 42. All the crosspieces are moved up or down along the toothed rack 42 by movement of the carriage 41. In the position provided the handle 40 is turned and the carriage 41 engages in the toothed rack 42.

In the normal training position the crosspieces L are each held by a respective damper 43 in the upper position—as illustrated. The damper is supported with one end on the lower crosspiece N and with its other end on the movable crosspiece L.

The detail of the illustrated fall protection device represents the rear section of the fall prevention device. This rear section can for example be fastened to a wall.

The rope 10 is guided downwards over a first guide roller 44 which is fastened to the stationary crosspiece M, and then over a guide roller 45 which is assigned to the movable crosspiece L. The end of the rope 10 is fixed on the crosspiece M.

In the event of the user falling the rope 10 is pulled in the arrow direction PI. As a result the crosspiece L moves in the direction of the crosspiece M until it comes to bear against a damping ring 46. The rope extension is limited. The movement takes place with damping by the damper 43. Alternatively the crosspiece L directly strikes the crosspiece M. A further possibility is that the damper 43 itself has an integrated stop.

The illustrated damper is a gas spring. The stroke of the gas spring is adjustable in such a way that the starting position can be fixed. Thus by presetting of the damper 43 it is possible to set the damping path and thus to adapt it to the user. The adjustment possibility is indicated by the actuating device 47.

Reference is made to FIG. 7. FIG. 7 shows an arm 14 of the fall protection device according to the invention in two views, namely both in a side view and in a top view. The rope 10 is led towards the rear over the guide roller 15, that is to say towards the left in FIG. 7, by the user (not shown).

The tautening device according to the invention is formed by a lever 48. The lever has a lever arm 49 which is pivotably mounted on the arm 14. On its end is mounted a guide roller 50 by which the lever arm deflects the rope 10. For improved representation four different operating states of the lever 48 are shown, wherein in the uppermost position of the lever arm 49 the rope 10 is taut and in the lowest position the rope (shown by dash-dot line) is deflected.

The rope 10 is guided downwards over a guide roller 51. The extension of the rope 10 is shown in FIG. 6.

The lever 48 preferably has a further guide roller 52 which is advantageously mounted on the axis of the lever arm 49. The pretension of the lever arm 49 on the rope 10 is adjustable. For this purpose a volute spring is disposed in the bearing housing 53 of the lever arm 49.

During the use of the trampoline the rope 10 is pulled out and in with each bounce. In order that the user does not experience any heteronomous changes of load which have a negative effect on the sense of balance, a significant requirement of the fall protection device is that the rope is held taut as uniformly as possible and with the least possible resistance. The lever 48 fulfils this requirement in a particularly advantageous manner.

A fall protection device which facilitates training of patients on a trampoline has been described above. It consists of the essential components comprising rope (safety line), rope tautening device and fall limiting device. The fall limiting device is not of necessity understood only as a stop within the context of the invention. As set out in connection with FIG. 6, the limiting device may have several components, in particular a stop or the like which defines the end position, optionally guide roller(s) and a damper. Thus the limiting device advantageously makes a rope extension available within which the user/patient is initially slowed down and finally securely caught. The catching position and/or the trigger position at which the rope limitation is initiated are preferably adjustable.

| List of references | |
|---|---|
| 1 | person/user |
| 2 | transport device |
| 3 | rail |
| 4 | carriage |
| 5 | rollers |
| 6 | safety device |
| 7 | vest |
| 8 | trampoline |
| 9 | steps |
| 10 | rope |
| 11 | holding bar |
| 12 | weight |
| 13 | stop |
| 14 | arm |
| 15 | guide roller |
| 16 | guide roller |
| 17 | guide roller |
| 18 | guide roller |
| 19 | damper |
| 20 | end stop |
| 21 | bar |

-continued

| List of references | |
|---|---|
| 22 | guide roller |
| 23 | guide roller |
| 24 | guide roller |
| 25 | bar |
| 27 | vertical strut |
| 28 | drive unit |
| 29 | threaded rod |
| 30 | drive unit |
| 31 | vertical support |
| 32 | horizontal support |
| 33 | transverse bar |
| 34 | transverse bar |
| 35 | mounting |
| 36 | locking device |
| 37 | guide bars |
| 38 | outer bar |
| 39 | outer bar |
| 40 | handle |
| 41 | carriage |
| 42 | toothed rack |
| 43 | damper |
| 44 | guide roller |
| 45 | guide roller |
| 46 | damping ring |
| 47 | actuating device |
| 48 | lever |
| 49 | lever arm |
| 50 | guide roller |
| 51 | guide roller |
| 52 | guide roller |
| 53 | bearing housing |
| 54 | volute spring |
| A | crosspiece |
| B | crosspiece |
| C | weights |
| D | upper drive unit |
| E | lower drive unit |
| F | crosspiece |
| G | mounting |
| H | crosspiece |
| K | crosspiece |
| L | crosspiece |
| M | crosspiece |
| N | crosspiece |
| P1 | arrow |

The invention claimed is:

1. Fall protection device for trampolines, including:

two ropes which are substantially non-resilient and can be connected to a user of an associated trampoline, wherein for each of the two ropes there is provided at least one tautening device which holds the rope taut when the fall protection device is in use, and at least one device for limiting an extension of each of the two ropes characterized in that the two ropes extend independently of each other so that an extension or retraction of one rope does not cause an extension or retraction of the other rope, and wherein the at least one device for limiting an extension of each of the two ropes is only triggered when the ropes are not deflected by the at least one tautening device.

2. Fall protection device as claimed in claim 1, characterized in that the device for limiting the rope extension has a stop.

3. Fall protection device as claimed in claim 1, characterized in that the device for limiting the rope extension has at least one damper.

4. Fall protection device as claimed in claim 3, characterized in that the degree of damping of the damper is adjustable.

5. Fall protection device as claimed in claim 3, characterized in that the damper is connected to one end of each rope.

6. Fall protection device as claimed in claim 1, characterized in that a free end of each rope is adjustable.

7. Fall protection device as claimed in claim 6, characterized in that the setting of the usable rope length takes place by adjustment of the device for limiting the rope extension.

8. Fall protection device as claimed in claim 6, characterized in that the fall protection device has a stationary toothed rack, and that the setting of the rope length takes place by way of a movable carriage which can be brought into engagement with the toothed rack.

9. Fall protection device as claimed in claim 1, characterized in that the fall height of the user is adjustable.

10. Fall protection device as claimed in claim 1, characterized in that the tautening device is separate from the device for limiting the rope extension.

11. Fall protection device as claimed in claim 1, wherein the at least one tautening device deflects each rope during use.

12. Fall protection device as claimed in claim 1, characterized in that the fall protection device has an arm.

13. Fall protection device as claimed in claim 12, characterized in that the arm extends with its front end over the trampoline.

14. Fall protection device as claimed in claim 12, characterized in that at least one of the tautening device and the device for limiting the rope extension are disposed in a rear region of the arm.

15. Fall protection device as claimed in claim 12, characterized in that the fall protection device has a transport device which is disposed so as to be movable along the arm.

16. Fall protection device as claimed in claim 15, characterized in that the transport device has a safety device.

17. Fall protection device as claimed in claim 1, characterized in that the two ropes are capable of being connected to a respective left and right side of the user.

18. Fall protection device as claimed in claim 17, characterized in that each rope is disconnected from the other and each is connected to a respective tautening device.

19. Fall protection device as claimed in claim 1, characterized in that the rope is guided over a guide roller which is flexibly movable, in particular pivotable, in order to adapt guiding of the rope to the user.

20. Fall protection device for trampolines, including:

two ropes which are substantially non resilient and are adapted to be connected to a user of an associated trampoline, wherein for each rope there is provided at least one tautening device which holds the rope taut when the fall protection device is in use, at least one device for limiting an extension of each of the two ropes wherein the two ropes are separate from each other such that an extension or retraction of one rope does not cause an extension or retraction of the other rope, wherein the at least one tautening device for each rope includes a pivotable lever via which the rope is deflected during use, and wherein the device for limiting the rope extension only limits rope extension when the rope is no longer deflected, and wherein the at least one device for limiting an extension of each of the two ropes is only triggered when the rope is no longer deflected.

21. Fall protection device as claimed in claim 20, characterized in that the lever bears against the rope with a pretension.

22. Fall protection device as claimed in claim 21, characterized in that a pretension of the lever is adjustable.

23. Fall protection device as claimed in claim 20, characterized in that the lever is mounted on one end on a bearing axis of the lever and that a guide roller for the rope is disposed on the bearing axis of the lever.

24. Fall protection device for trampolines, including at least one rope which is adapted to be connected to a user of an associated trampoline, at least one tautening device which holds the rope taut when the fall protection device is in use, at least one device for limiting an extension of the rope, wherein the tautening device includes a device for deflecting the rope, and wherein the at least one device for limiting an extension of the at least one rope is only triggered when the at least one rope is no longer deflected.

* * * * *